United States Patent [19]

Barnhill, III et al.

[11] Patent Number: 4,512,220

[45] Date of Patent: Apr. 23, 1985

[54] FAST LEAD SOCKET WRENCH

[75] Inventors: Martin L. Barnhill, III, Union Grove; William T. Pagac, Kenosha, both of Wis.

[73] Assignee: Snap-on Tools Corporation, Kenosha, Wis.

[21] Appl. No.: 640,534

[22] Filed: Aug. 13, 1984

Related U.S. Application Data

[63] Continuation of Ser. No. 364,255, Apr. 1, 1982, abandoned.

[51] Int. Cl.[3] ..... B25B 13/06

[52] U.S. Cl. ..... 81/121.1

[58] Field of Search ..... 81/119, 121 R

[56] References Cited

U.S. PATENT DOCUMENTS

| | | | |
|---|---|---|---|
| 3,273,430 | 9/1966 | Knudsen et al. | 81/121 R |
| 3,466,956 | 9/1969 | Bowers | 81/121 R |
| 3,495,485 | 2/1970 | Knudsen et al. | 81/121 R |

*Primary Examiner*—Frederick R. Schmidt

*Attorney, Agent, or Firm*—Emrich & Dithmar

[57] ABSTRACT

A socket wrench for an hexagonal fastener wherein the clockwise and counterclockwise drive portions of the internal surface configuration of the wrench engage an associated hexagonal fastener with substantially surface to surface contact on each fastener side in close proximity to, but always spaced from, a fastener corner, thereby providing a maximum practical moment arm between wrench and fastener, and yet avoiding deteriorating engagement between the wrench and the fastener corners. The clockwise and counterclockwise drive portions of the wrench occupy the middle about ½ of each uniform 60° segment of the wrench opening. The space on the internal surface configuration of the wrench between adjacent pairs of drive portions is relieved just enough to avoid interference with the corners of the fastener, thereby providing a rotational clearance of about 25° with the fastener, the precise angular amount depending on manufacturing tolerances in the wrench and fastener. This extended rotational clearance is particularly advantageous in the field of power driven socket wrenches, especially power driven socket wrenches of the multiple spindle type commonly used in manufacturing operations.

7 Claims, 5 Drawing Figures

FAST LEAD SOCKET WRENCH

This is a continuation of application Ser. No. 364,255, filed Apr. 1, 1982 now abandoned.

This invention relates to a socket wrench for an hexagonal fastener, and more particularly to such a socket wrench wherein the average rotational clearance of the wrench with the fastener is about 25°, an angular clearance considerably greater than that found in the closest prior art known to applicants. This increased rotational clearance is of major significance in the field of power driven socket wrenches, especially power driven socket wrenches of the multiple spindle type commonly used in manufacturing operations.

The socket wrench of the invention features clockwise and counterclockwise drive portions which engage the fastener with substantially surface to surface contact on each fastener side in close proximity to, but always spaced from, a fastener corner. This feature provides the maximum practical moment arm between wrench and fastener, and yet avoids deteriorating engagement between the wrench and fastener corners. Such deteriorating engagement, of course, would produce objectionable deformation of the fastener corners.

The closest prior art known to applicants is a line of commercial products sold by applicants' assignee, Snap-on Tools Corporation, starting in or about 1957. This line is illustrated and described in terms of dimensions on data sheet No. 60-1-36, dated Nov. 17, 1965, entitled Single Hex Surface Drive. A copy of this sheet is forwarded as part of a Prior Art Statement.

Also forwarded as part of a Prior Art Statement are copies of Knudsen et al. U.S. Pat. Nos. 3,273,430 and 3,495,485. These patents pertain to the same general subject matter as the present invention. However, the present invention is regarded by applicants and their associates at applicants' assignee as a 400 percent improvement over the socket wrenches disclosed in those patents in terms of angular or rotational clearance.

BRIEF SUMMARY OF THE INVENTION

The invention contemplates a socket wrench for an hexagonal fastener wherein the internal surface configuration of the wrench has an average rotational clearance of about 25° with the fastener. "Average rotational clearance", as used here, means the rotational clearance between wrench and fastener when the former is rotated between clockwise drive and counterclockwise drive positions under circumstances wherein the socket wrench and fastener are constructed to exact design specifications, i.e., no tolerances are contemplated in either the wrench or fastener. As a practical matter, of course, tolerances in both are encountered, meansing that the actual rotational clearance between wrench and fastener always falls within an angular range, the minimum and maximum limits of this range and the actual clearance depending, of course, on the tolerances possessed by specific wrenches and fasteners.

The clockwise and counterclockwise drive portions of the wrench engage the fastener with substantially surface to surface contact on each fastener side in close proximity to, but always spaced from, a fastener corner. This feature, of course, affords maximum practical moment arm between wrench and fastener, and yet avoids deteriorating engagement between the wrench and fastener corners. Any such deteriorating engagement between wrench and corners, of course, objectionably deforms the fastener corners, leading to an unduly short life for the fasteners.

The clockwise and counterclockwise drive portions of the socket wrench of the invention occupy the middle about ½ of each uniform 60° segment of the wrench opening. The angular space between adjacent pairs of drive portions are relieved to avoid interference with the corners of the fasteners, thereby providing the important extended rotational clearance that characterizes the invention.

In a preferred form of the invention, the external angulation between the clockwise and counterclockwise drive portions in each 60° segment of the wrench opening is about 200°. This angulation cooperates to provide the surface to surface drive contact between wrench and fastener.

In more detailed aspect, the rotational clearance between the wrench embodying the invention and the fastener falls in the range of about 20° to 30°, the actual rotational clearance angle depending, as intimated above, on the dimensional tolerances of the wrench and fastener.

The clockwise and counterclockwise drive portions of the wrench embodying the invention are substantially flat surfaces, thereby to provide the substantially surface to surface contact on each fastener side. All other surfaces of the wrench opening are curved surfaces, whereby stress concentrations incident to non-curved corners are avoided, and wrench life is prolonged significantly.

As will be seen, the socket wrench strength is determined by the wrench wall thickness in the relieved angular spaces between adjacent pairs of drive portions.

Other objects, advantages and features of the invention will be apparent as the description proceeds, reference being had to the accompanying drawings wherein one form of the invention is shown. A representation of the closest prior art known to applicants is shown for comparison purposes. It is to be understood that the description and drawings are illustrative only, and that the scope of the invention is to be measured by the appended claims.

DETAILED DESCRIPTION

Figure 1:
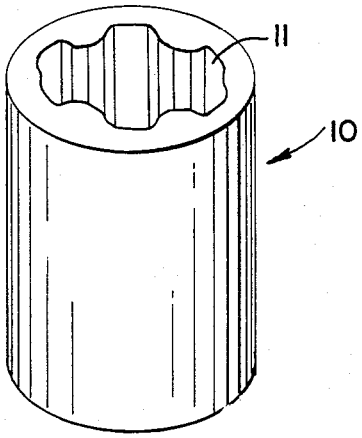
FIG. 1 is a perspective view of a socket wrench embodying the invention.
Figure 2:
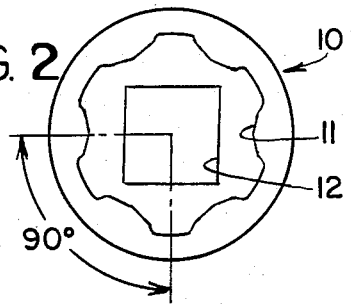
FIG. 2 is a top plan view of the wrench shown in FIG. 1.

Referring first to FIGS. 1 and 2 of the drawings, a socket wrench embodying the invention is generally designated 10. The internal surface configuration of the wrench which essentially comprises the present invention is generally designated 11. The square-shaped opening which receives the square-shaped drive element (not shown) of the wrench is designated 12 in FIG. 2. Drive opening 12, of course, is at the end of wrench 10 opposite to that of the internal surface configuration 11 which cooperates with an associated hexagonal fastener (not shown in FIGS. 1 and 2).

Figure 3:
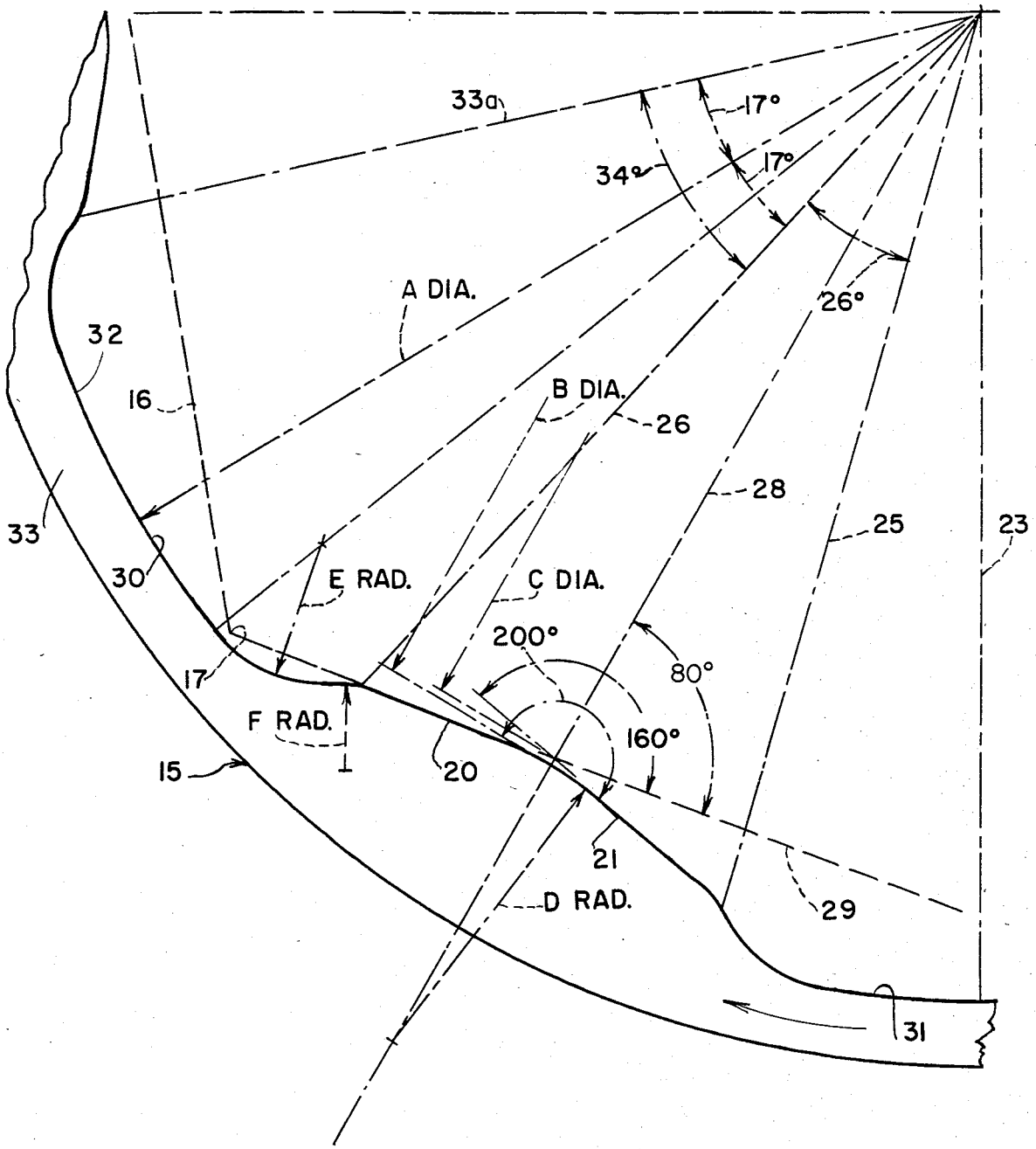
FIG. 3 is an enlarged view of the wrench quadrant designated 90° in FIG. 2, the FIG. 3 view showing details of the internal surface configuration of the wrench. A fragmentary outline of an associated fastener is shown in broken line.

FIG. 3 illustrates an enlarged segment of wrench 10 corresponding generally to the segment designated 90° in FIG. 2 The wrench segment shown in FIG. 3 is designated 15. A fragmentary portion of an associated fastener shown in broken line is designated 16, a corner thereof being shown at 17. Fastener 16 is shown in clockwise driven relation with wrench 15.

FIG. 3 includes angular designations 80°, 160° and 200° which will be referred to later, and various legends, namely, A DIA. (for diameter), B DIA., C DIA., D RAD. (for radius), E RAD. and F RAD. The A, B, C, D, E, and F portions of these legends are keyed to a table of dimensions which will be set forth later. These dimensions constitute an accurate disclosure which will enable one skilled in the art to construct socket wrenches of various sizes in accordance with this invention.

Still referring to FIG. 3, the clockwise drive surface in the illustrated wrench segment is designated 20, while the adjacent counterclockwise drive surface is designated 21. The two drive surfaces 20 and 21 occupy the middle about ½ of each uniform 60° segment of the wrench opening. The uniform 60° segment of wrench opening just referred to is that portion of the wrench opening in FIG. 3 which extends between diameter line labelled A DIA. and the vertical line designated 23 at the right. It will be noted that the angular extent of the drive surfaces 20 and 21 occupy the middle about ½ of the designated uniform 60° segment. The middle about ½ of the segment is bounded approximately by radial lines 25 and 26 in FIG. 3. The angle therebetween is designated 26°±.

The external angulation between clockwise drive portion 20 and counterclockwise drive portion 21 in each 60° segment is about 200°. This relationship is designated 200° in FIG. 3. The curved surface between drive portions 20 and 21 is determined by D RAD., and is tangential to the drive portion.

The radial line in FIG. 3 which bisects the theoretical sharp corner of drive portions 20 and 21 is designated 28. This line, as shown in FIG. 3, has an 80° relationship with the extension of drive surface 20, the 80° angle being shown between line 28 and the adjacent side 29 of fastener 16 which is substantially colinear with drive surface 20. A similar 80° angle, of course, exists between line 28 and the extension of counterclockwise drive surface 21. These 80° relationships are mentioned here because they also are mentioned in the table appearing hereafter, the drive surfaces 20 and 21 being referred to therein as "the two 80° flats."

Still referring to FIG. 3, the radial lines 25 and 26 roughly designate the angular extent of the clockwise and counterclockwise drive surfaces 20 and 21. This angle, as mentioned, is designated 26°± in FIG. 3 although it will be understood that the precise angle will vary depending on the tolerances involved in the manufacture of a specific wrench. This angle is referred to in the claims as "occupying the middle about ½ of each uniform 60° segment of the wrench opening." The mentioned uniform 60° segment of the wrench opening shown in FIG. 3 lies between line 23 and the line designated A DIA.

The internal surface configuration of the wrench within each uniform 60° segment of the wrench opening on either side of the middle about ½ of each segment comprises curved surfaces 30 and 31 in FIG. 3. Thus, wrench surface 30 lies between radial line 26 and the line designated A DIA., and wrench surface lies between radial lines 23 and 25.

Referring to the left of FIG. 3, wrench surface 32 lying between the line designated A DIA. and radial line **33*a* corresponds to the previously mentioned wrench surface 31 at the right in FIG. 3. Thus, adjacent wrench surfaces 30 and 32 together occupy the angular space between adjacent pairs of drive portions 20 and 21, and this space on the wrench surface is relieved, as shown by the surfaces 30 and 32, to avoid interference with the corner 17 of the fastener 16 when the wrench is rotated between the illustrated clockwise drive position and the alternative counterclockwise drive position where drive surface 21 engages the adjacent side 29 of fastener 16. The amount of this relief, as shown, is just enough to avoid interference with a corner 17, thereby providing maximum thickness in the wrench wall 33 which defines wrench surfaces 30 and 32. Wrench strength, of course, is a function of the thickness of wall 33, and this thickness is maximized by virtue of the relatively small clearance provided between relieved surfaces 30 and 32 and corner 17** of an associated fastener and by reverse curved wrench surfaces of minor angular extent between the drive portions and the relieved surfaces.

Figure 4:
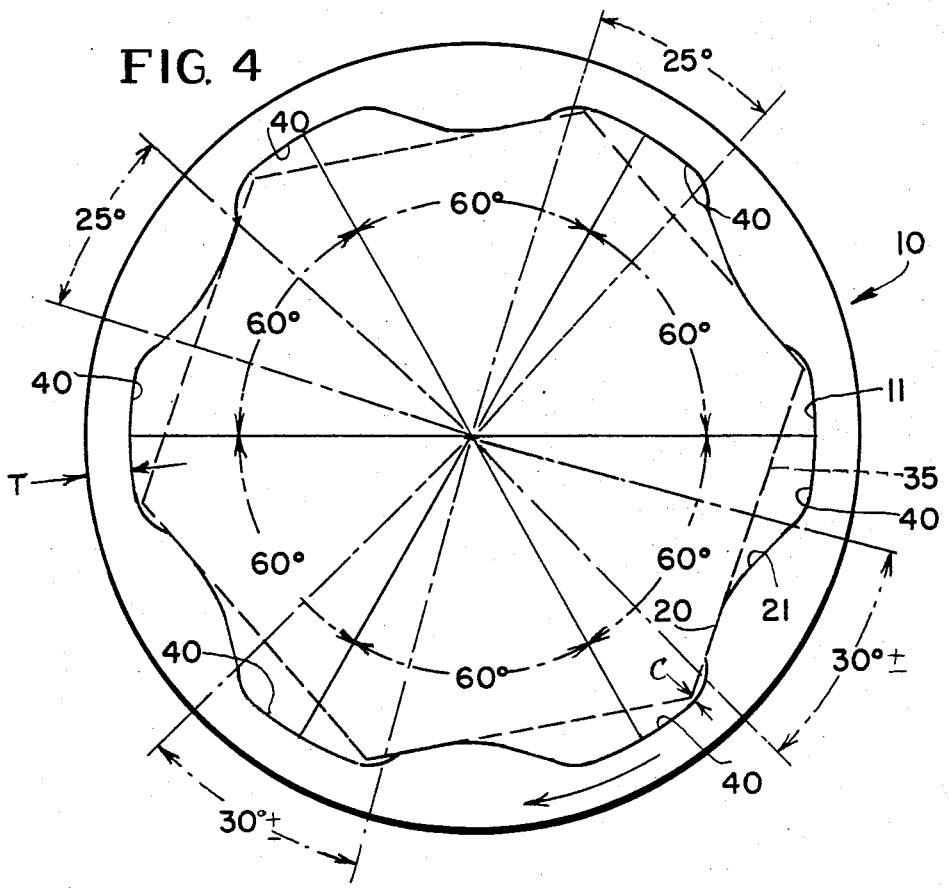
FIG. 4 is a top plan view of a socket wrench embodying the invention, and associated hexagonal fastener being shown in broken line in clockwise driven relation with the wrench.

Referring to FIG. 4, socket wrench 10 embodying the internal configuration 11 of the invention is shown in top plan view, enlarged as compared to FIG. 2. The square opening for the drive member, designated 12 in FIG. 2 has been omitted for clarity and in order to show various angular relationships. An associated hexagonal fastener 35 is illustrated in broken line, wrench 10 being shown in clockwise drive relationship with fastener 35.

The uniform 60° segments of the wrench opening defined by configuration 11 are shown by solid radial lines terminating at the wrench surface which defines configuration 11. These six segments are respectively designated 60°. As will be seen in FIG. 4, each radial line enclosing a 60° segment intersects the internal wrench surface at about the mid point of a relieved surface comprising adjacent surfaces 30 and 32 (FIG. 3). The six composite relieved surfaces shown in FIG. 4 are each designated 40.

As shown at the lower left in FIG. 4, the relieved surface 40 is shown as having an angular extent of 30°±. The precise angle, as previously mentioned, depends on tolerances involved in the manufacture of the wrench.

At the upper right, the angular extent of a portion of the composite relieved surface 40 is designated 25°. This angular amount represents the previously mentioned "average rotational clearance" between wrench and fastener as the wrench rotates between the illustrated clockwise drive position and the alternate counterclockwise drive position. The precise rotational clearance, again, depends on tolerances in the manufacture of the wrench, and also tolerances in the fastener.

Still referring to FIG. 4, lower right, the clockwise and counterclockwise drive surfaces 20 and 21, as previously mentioned, occupy the middle about ½ of the associated uniform 60° segment, and the angular extent of drive portions 20 and 21 is labelled 30°±. Again, the precise angulation depends on tolerances.

Socket wrenches embodying the invention, especially those intended for power drive applications, preferably are provided with a lead-in chamfer of desired angular extent, for example, 90°. This lead-in chamfer, together with the extended rotational or angular clearance of the invention, promotes smooth engagements between turning sockets and stationary fasteners. This feature is especially important in multiple spindle power drive applications wherein neither the wrenches nor the fasteners likely have initial uniform orientation.

The present invention readily can be practiced by one skilled in the art through the use of actual dimensions determined from the following table. The locations of the respective dimensions A, B, C, D, E and F are shown in FIG. 3. The dimensions in effect determine the accurate shape of wrench configuration 11 around the entire 360° of the wrench opening.

In the following table, the dimensions A, B, etc. have maximum and minimum values, the difference between the two representing acceptable tolerances. The actual dimensions in the wrench must fall between the maximum and minimum values in each instance.

Table for Calculation of Actual Dimensions

W = WRENCH OR FASTENER SIZE IN INCHES

| | | | |
|---|---|---|---|
| A | MAX. = 1.1662 W + .0058 | D | MAX. = .1910 W + .0390 |
| | MIN. = 1.1605 W + .0012 | | MIN. = .1455 W + .0284 |
| B | MAX. = 1.0254 W + .0050 | E | MAX. = .0791 W + .0030 |
| | MIN. = 1.0204 W + .0010 | | MIN. = .0766 W + .0010 |
| C | MAX. = 1.0204 W + .0040 | F | MAX. = .0396 W + .0015 |
| | MIN. = 1.0154 W | | MIN. = .0383 W + .0005 |

NOTES:
1. "C" DIA. is the distance between opposite theoretical sharp corners of the two 80° flats.
2. "D" RAD. is tangent to the two 80° flats and passes thru the "B" DIA.
3. "E" RAD. is swung from a line that radiates from the center of the configuration and passes thru the intersection of "A" DIA. and the 80° flats and is tangent to "A" DIA. at that intersection.

It will be understood that the above table read in connection with FIG. 3 will enable one to practice the invention with socket wrenches over a desired range of wrench sizes. While the actual dimensions derived from the above table are set forth in inches such inch dimensions readily can be converted to the metric system, or any other desired system of measurement.

Figure 5:
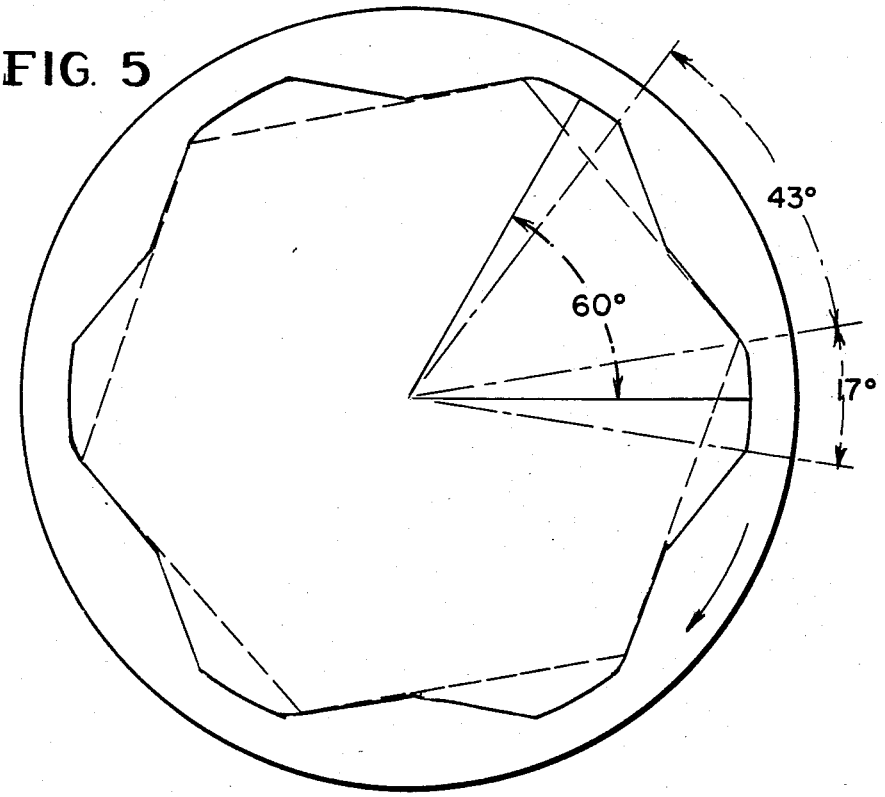
FIG. 5 is a top plan view of the socket wrench applicants believe is the closest prior art approach to the wrench of the invention, and associated hexagonal fastener being shown in broken line in clockwise driven relation with the wrench.

FIG. 5 of the drawings represents a socket wrench 50 which applicants believe represents the closest approach in the prior art to subject invention. This wrench previously was mentioned herein as a commercial product of applicants' assignee that was introduced some time in the late 1950's. This wrench features a substantially surface to surface contact in the drive relationship with an associated hexagonal fastener 51.

The primary important difference between the two wrenches 10 and 50 resides in the fact that the wrench 50 has an average rotational clearance of about 17° between the wrench and associated fastener 51. This angulation is indicated by the segment designated 17°± at the right in FIG. 5. In general, the angulation corresponds with the relieved portion of the wrench 50 which avoids interference with a corner 52 of fastener 51 in moving between clockwise and counterclockwise drive, the precise angulation again depending on manufacturing tolerances.

As a corollary to the aforesaid clearance angulation of 17°±, the angular extent of the combined clockwise and counterclockwise drive portions 54 and 55 of the wrench configuration is designated 43°± in FIG. 5. These angles may be compared with the corresponding angles of 25°± and 30°± present in subject invention. The difference in favor of the present invention is one of importance in power driven applications, particularly power driven applications of the multiple spindle type.

The socket wrench disclosed in aforesaid U.S. Pat. Nos. 3,273,430 and 3,495,485 has an average rotational clearance with an associated fastener of about 6°±, and thus is not suitable for power driven applications, or use in relatively inaccessible locations which require generous rotational clearance.

From the above description, it is believed that the construction and advantages of the invention will be readily apparent to those skilled in the art. Various changes in detail may be made without departing from the spirit or losing the advantages of the invention.

Having thus described the invention, what is claimed as new and desired to be secured by Letters Patent:

1. A socket wrench for a fastener having a predetermined across-corners dimension, said socket wrench having an internal surface comprising a plurality of pairs of adjacent clockwise and counterclockwise drive surfaces, the drive surfaces in each pair being substantially flat and lying in planes intersecting at a predetermined angle, a corresponding plurality of relieved surfaces respectively between said pairs of drive surfaces, each of said relieved surfaces having a predetermined diameter slightly greater than the predetermined across-corners dimension, a corresponding plurality of first reverse curved surfaces respectively between said relieved surfaces and said clockwise drive surfaces, a corresponding plurality of second reverse curved surfaces respectively being between said relieved surfaces and said counterclockwise drive surfaces, each of said reverse curved surfaces having a given radius and being tangent to the associated relieved surface, each of said relieved surfaces having an angular extent greater than the angular extent of each of said reverse curved surfaces, each of said relieved surface having a radius greater than the radius of each of said reverse curved surfaces.

2. The socket wrench of claim 1, wherein said internal surface further comprises a plurality of further curved surfaces, each further curved surface being between each pair of clockwise and counterclockwise drive surfaces and being tangent respectively thereto and having a given radius.

3. A socket wrench for a fastener having six sides and a predetermined across-corners dimension, said socket wrench having an internal surface comprising six pairs of adjacent clockwise and counterclockwise drive surfaces, the drive surfaces in each pair being substantially flat and lying in planes intersecting at a predetermined angle, six relieved surfaces respectively between said pairs of drive surfaces, each of said relieved surfaces having a predetermined diameter slightly greater than the predetermined across-corners dimension, six first reverse curved surfaces respectively between said relieved surfaces and said clockwise drive surfaces, six second reverse curved surfaces respectively being between said relieved surfaces and said counterclockwise drive surfaces, each of said reverse curved surfaces having a given radius and being tangent to the associated relieved surface, each of said relieved surfaces having an angular extent greater than the angular extent of each of said reverse curved surfaces, each of said relieved surface having a radius greater than the radius of each of said reverse curved surfaces.

4. The socket wrench of claim 3, wherein said predetermined angle is about 200°.

5. The socket wrench of claim 3, wherein each of said relieved surfaces has an angular extent within the range of about 20° to 30°.

6. The socket wrench of claim 3, wherein each of said of drive surfaces has an angular extent of about 26°.

7. The socket wrench of claim 3, wherein the angular extent of each of said relieved surfaces together with the adjacent first and second reverse curved surfaces is about 34°.

* * * * *